United States Patent [19]

Morrison

[11] Patent Number: 4,555,200

[45] Date of Patent: Nov. 26, 1985

[54] HYDRAULICALLY-POWERED MATERIAL SPREADER

[76] Inventor: Donald R. Morrison, 6228 Eagle Peak Dr., Charlotte, N.C. 28214

[21] Appl. No.: 593,108

[22] Filed: Mar. 26, 1984

[51] Int. Cl.[4] ..... E01C 19/20; F28D 21/00

[52] U.S. Cl. ..... 404/72; 404/79; 404/95; 404/101; 404/108; 404/110; 60/456; 165/1; 165/185

[58] Field of Search ..... 404/101, 104–106, 404/108–111, 95, 72, 79; 184/6.22; 60/456; 165/1, 47, 185

[56] References Cited

U.S. PATENT DOCUMENTS

| | | | |
|---|---|---|---|
| 1,296,124 | 3/1919 | Schettler | 184/6.22 X |
| 2,361,249 | 10/1944 | Venable | 165/185 |
| 3,487,431 | 12/1969 | Forkner | 60/456 X |
| 3,751,174 | 8/1973 | Layton | 404/108 |
| 3,874,807 | 4/1975 | Puckett et al. | 404/110 |
| 3,907,451 | 9/1975 | Fisher et al. | 404/101 |
| 4,349,294 | 9/1982 | Allen | 404/110 |
| 4,411,554 | 10/1983 | Gratzfeld | 404/110 |

*Primary Examiner*—James A. Leppink
*Assistant Examiner*—Beverly E. Hjorth
*Attorney, Agent, or Firm*—B. B. Olive

[57] ABSTRACT

A material spreader for spreading a topping material over a wet concrete surface utilizes a pair of hoppers which are driven back and forth on a bridge support spanning the surface. A gasoline engine mounts above the hoppers and furnishes power for a reversibly controllable hydraulic hopper drive motor. The motor is part of a hydraulic system in which the hydraulic fluid is cooled by using both a hopper wall as well as the flowing material being spread as heat sinks.

3 Claims, 8 Drawing Figures

HYDRAULICALLY-POWERED MATERIAL SPREADER

TECHNICAL FIELD

The present invention relates to material spreaders and more particularly to material spreaders of the type having bridge-supported hoppers which move back and forth across and above a wet concrete surface and deposit a uniform amount of topping material over the surface.

BACKGROUND ART

The prior art includes a variety of different types of material spreaders. Conventional lawn fertilizer spreaders include a hopper and a finger agitator rotated by spreader wheels. More closely related to the invention apparatus are material spreaders adapted for use in conjunction with the pouring and working of concrete spans. A number of companies make material spreaders for evenly spreading a layer of topping material on the wet surface of spans of concrete. The conventional spreader mounts one or more hoppers on a bridge which spans the width of the concrete and the hoppers are driven back and forth on the bridge to spread the material and the bridge which is mounted on wheels is manually moved lengthwise of the span after each pass of the hoppers. The hopper drive mechanism for a spreader of this type is typically powered either electrically or pneumatically which requires either power cables or air lines to be fed back and forth across the concrete span being worked. Such arrangements inherently require additional support structure and expense for the added structure, cables and air lines. U.S. Pat. No. 4,349,294 describes one such spreader. Trade literature distributed by K and G Equipment Design, Inc., of Yankton, South Dakota describes the "K and G" material spreader, another such spreader. Also, U.S. Pat. No. 4,411,554 describes a spreader having an electric drive and two spaced apart hoppers on a bridge.

With the foregoing in mind, the present applicant recognized that it would be desirable to provide an improved material spreader adapted for spreading a layer of material on the surface of a span of wet concrete and with a gasoline engine hydraulic system to drive the spreader so that neither power cables or air lines would be required. The achieving of a practical gasoline engine powered hydraulic system with an inherent ability to accommodate to either drive wheel or hopper agitator jamming has thus been one object of the invention.

With the object of achieving a practical gasoline engine powered hydraulic system which accommodates jamming as an object, applicant has discovered after a period of trial and experimentation with use of a hopper as a heat sink and with various gasoline engine powered hydraulic drive and hydraulic fluid-cooling arrangements that the means employed for dissipation of the heat generated in the oil being used to drive the spreader becomes a significant consideration. Prior attempts to use a hopper wall as a reservoir wall have not proven successful. Thus, another object of the invention has been that of achieving a practical gasoline engine powered hydraulic system for a bridge-supported material spreader with an improved hopper-reservoir arrangement to dissipate the heat accumulated in the oil used to drive the hydraulic elements of the system.

Another disadvantage of the prior art material spreaders of the type in which two spaced-apart hoppers are mounted on opposite sides of a bridge is that each hopper lays down a separate strip of material on each pass resulting in two laterally-spaced, narrow strips on each pass rather than one relatively wide strip of material on each pass. Thus, another object of the present invention is to achieve a material spreader with a hopper arrangement in which a relatively wide single span of material can be layed down on each pass of the spreader to avoid having to fill in between spaced-apart strips of material. Also, while driven paddle wheels in hoppers have been employed, it has not been known to drive the paddle wheel by an individual hydraulic motor as in the present invention so as to provide both independent paddle wheel spaced control and improved jamming action.

The foregoing and other objects will become apparent as the description proceeds.

DISCLOSURE OF INVENTION

The present invention provides a material spreader which moves back and forth across and above a wet concrete surface and uniformly spreads on a wide single width of topping material on the surface on each pass of the spreader. The typical concrete span is rectangular in shape, has length and width, is bounded by forms during pouring and material spreading and normally is fitted to the location of building columns. A bridge is supported above and spans the width of the concrete span and is fitted with wheels for movement of the spreader lengthwise of the span. A pair of oppositely-disposed hoppers are movably supported on the bridge and store a supply of material, e.g., sand, which is dispensed from the hoppers through a spreader box which joins each of the hoppers and lays down a single, wide, uniform width of topping material on each pass. The hoppers and spreader box are mounted on a support structure which is driven back and forth along an elevated path by means of gasoline engine powered hydraulic apparatus also mounted on the same support structure. Heat, which accumulates in the hydraulic fluid during operation of the spreader, is dissipated by means of an improved reservoir/hopper-cooling arrangement which allows the heat to be absorbed both by a hopper wall and by the material being spred which significantly contributes to making the invention system practical.

BEST MODE FOR CARRYING OUT THE INVENTION

Figure 1:
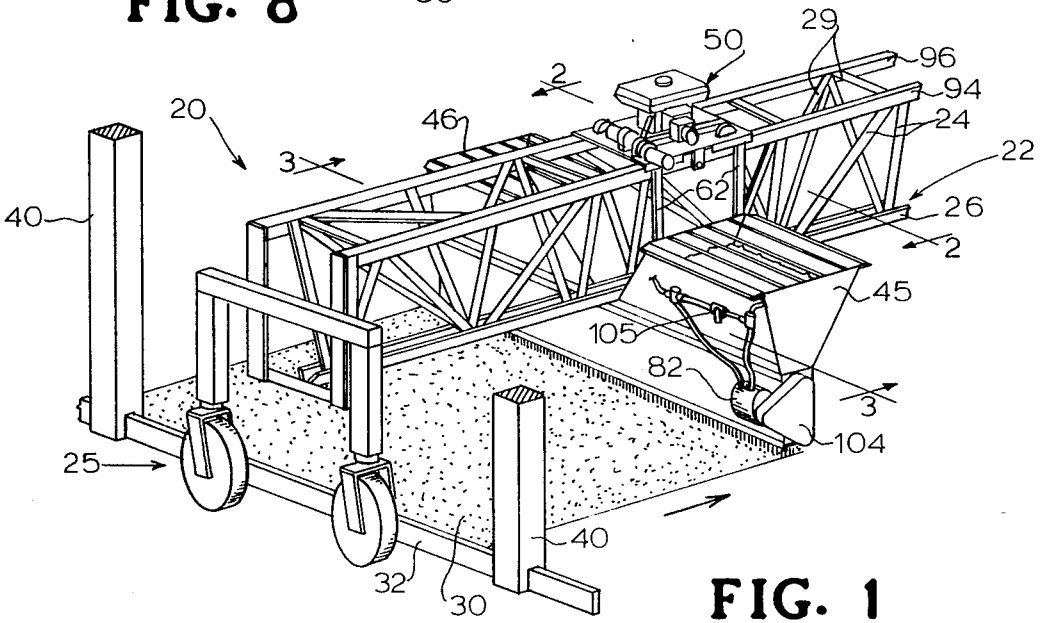
FIG. 1 is a fragmentary pictorial view of the hydraulically-powered material spreader of the invention in use spreading a topping material, e.g., sand, along the surface of a form-contained span of wet concrete with the material spreading being depicted as moving from left to right.

Referring initially to FIG. 1, there is illustrated the spreader 20 of the invention fitted with a bridge 22 and sets of wheels 25 on each end of the bridge 22, only one set being shown, for moving bridge 22 lengthwise of the rectangular-shaped span of wet concrete 30 confined by forms 32, only one such form being illustrated. Typical building columns 40 are illustrated about which spreader 20 is required to be moved during completion of the spreading process. Thus, bridge 22 is formed of a lightweight, open network of interconnected aluminum frame pieces to facilitate movement around columns 40 as well as transport from job site to job site. Side pieces 24 are welded or bolted between lower V-member 26 and later referred to upper rail beams 94, 96, located on either side of top pieces 29 to which rail beams 94, 96 are suitably joined.

A pair of open, inwardly-tapered hoppers 45, 46 are suspended on either side of bridge 22. Hoppers 45, 46 are suspended from a support structure which is driven back and forth lengthwise of bridge 22 by means of a gasoline engine driven hydraulic pump and motor system 50, as later described. From this brief description of FIG. 1, it will be appreciated that when material spreader 20 of the invention is used to spread a uniform, wide, single layer of topping material over the span of wet concrete 30, hoppers 45, 46 are filled with the appropriate material to be spread and are driven back and forth along bridge 22 with spreader 20 being advanced after each pass in one direction so as to provide uniform coverage over the entire surface of concrete span 30.

Figure 8:
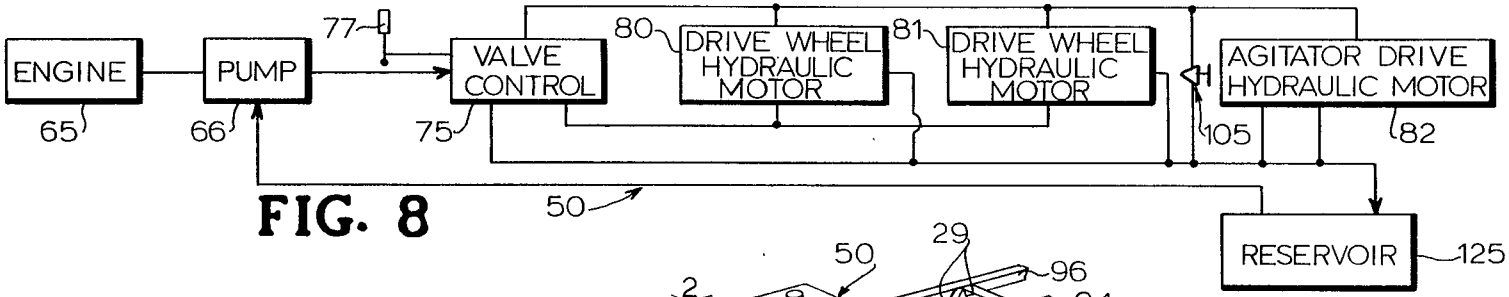
FIG. 8 is a schematic illustration of a hydraulic fluid system used with the invention.

Referring next to FIGS. 2–6, hoppers 45, 46 are shown suspended by bars 62 from support structure 60 formed by a base plate 61. Previously-mentioned engine-hydraulic drive assembly 50 mounts on base member 61 and includes a small gasoline engine 65, e.g., 5 horsepower, a hydraulic pump 66, coupling 72, a hydraulic control valve 75 with a control lever 77 and hydraulic motors 80, 81, 82 with the mentioned components interconnected as schematically illustrated in FIG. 8.

Gasoline engine 65 drives hydraulic pump 66 through coupling 72. Pump 66 through hydraulic control valve 75 and associated control lever 77 in turn control the operation and direction of rotation of hydraulic motors 80, 81, 82. Hydraulic motors 80, 81 drive wheels 90, 91 which power the support structure 60 and cause the hoppers 45, 46 to move back and forth along bridge 22. Hydraulic motor 82 in turn drives the hopper paddle and metering wheels 88, 89 (see FIGS. 2 and 3). Thus, in the event of jamming of either the drive wheels 90, 91, the support structure 60 or the paddle and metering wheels 88, 89, the hydraulic motors 80, 81, and 82 provide a shock-absorbing, clutch-like effect. Wheels 92, 93 also provide additional support for support structure 60. Wheels 90–93 are mounted on back plate 61 and extend through openings 98 (FIG. 6) therein to facilitate riding on the rails 94, 96.

Figure 2:
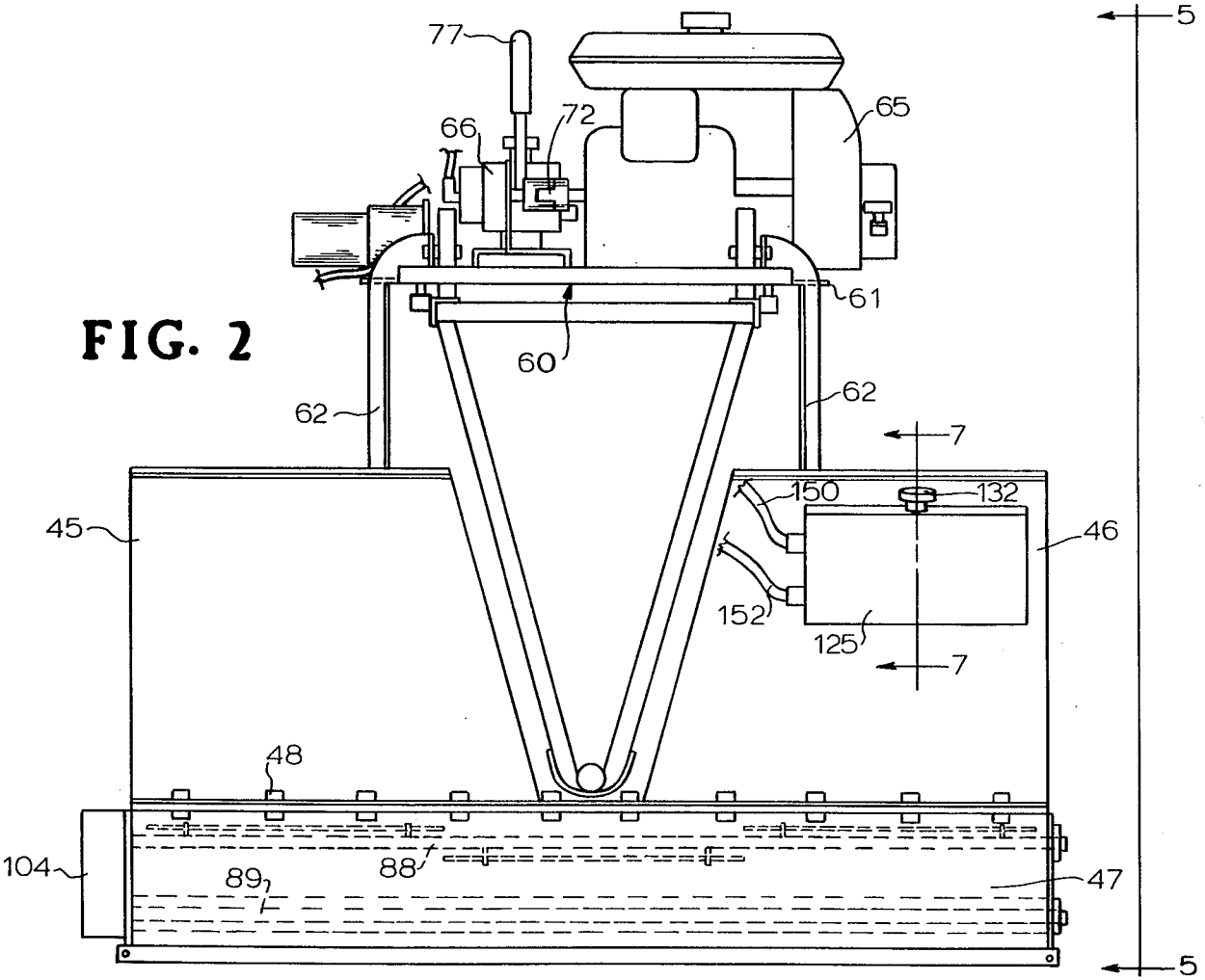
FIG. 2 is an enlarged side elevation view taken generally along line 2—2 of FIG. 1 and with portions of the bridge structure in section or eliminated for clarity of illustration.
Figure 3:
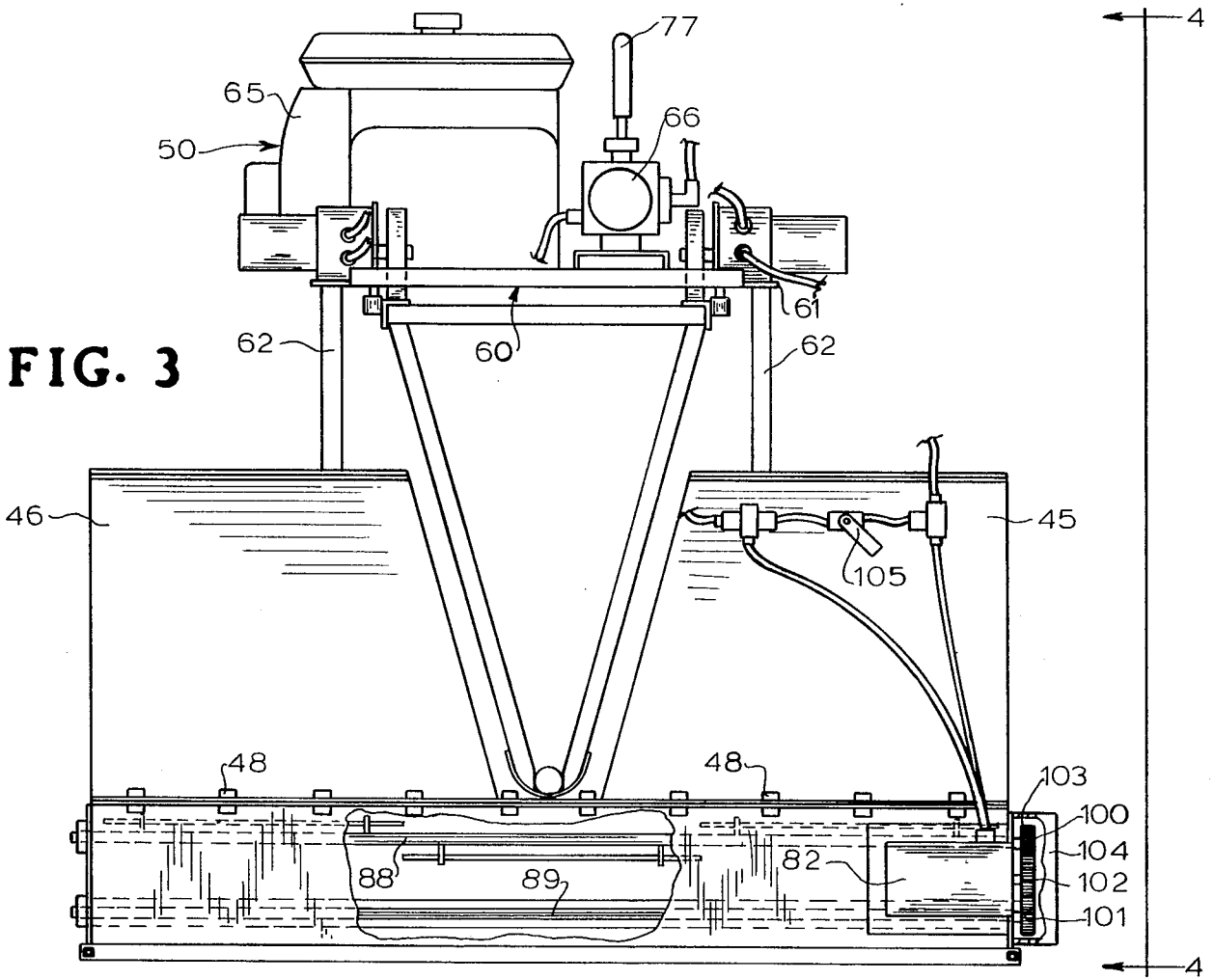
FIG. 3 is an enlarged side elevation view taken generally along line 3—3 of FIG. 1 and with portions of the bridge structure in section or eliminated for clarity of illustration.
Figure 5:
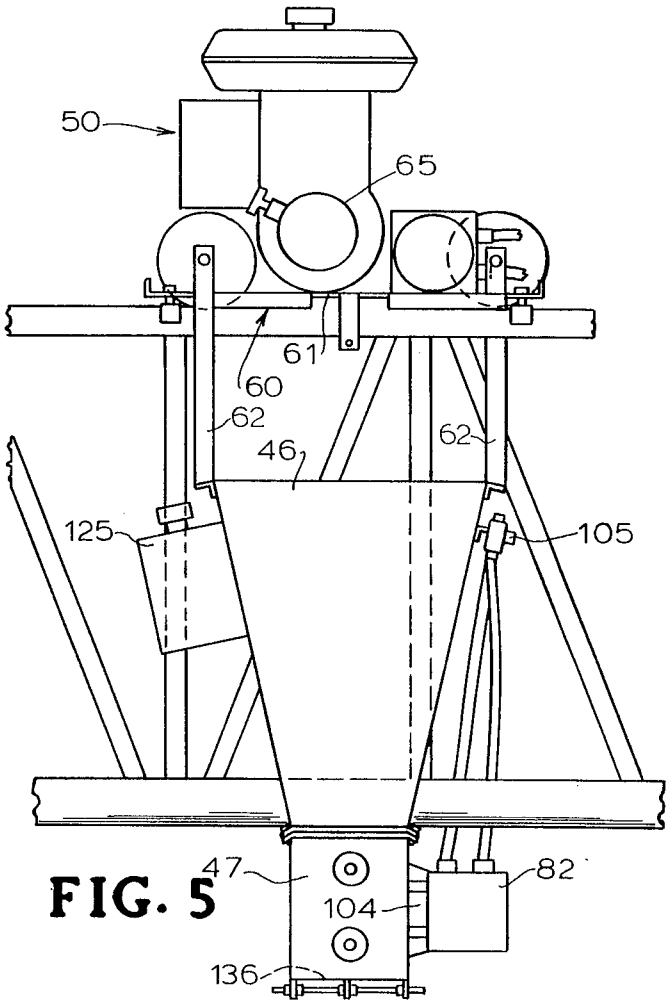
FIG. 5 is a end view taken in the direction of line 5—5 of FIG. 2 and also with the bridge structure eliminated for purposes of clarity.
Figure 4:
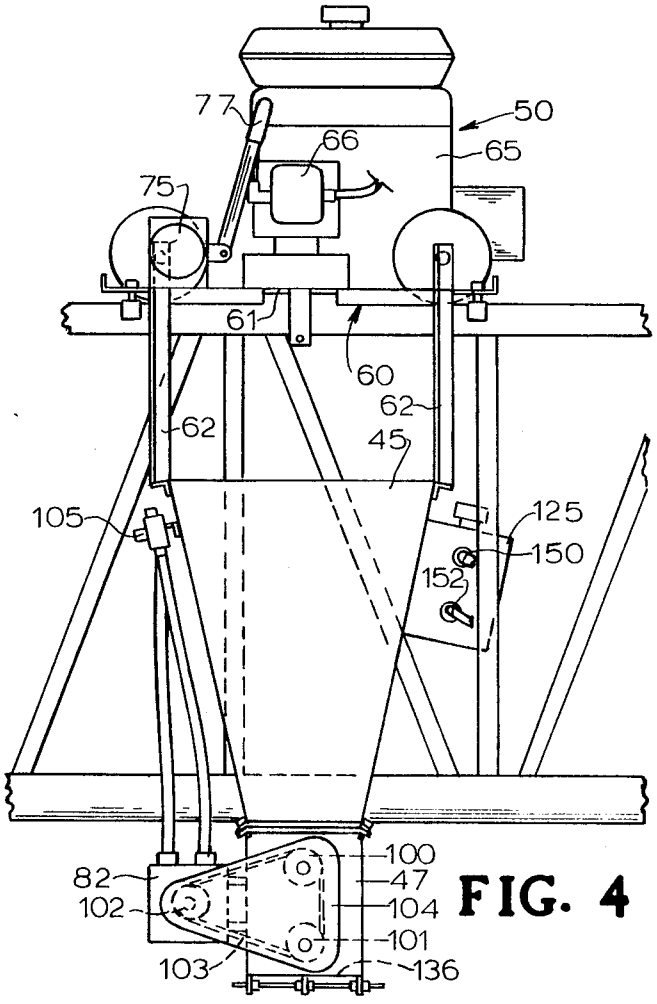
FIG. 4 is an end view taken in the direction of line 4—4 of FIG. 3 and with the bridge structure eliminated for clarity of illustration.

Hoppers 45, 46 empty into spreader box 47 which has agitator paddle wheel 88 and metering wheel 89 located therein with wheel 89 being adjacent the discharge area (see FIGS. 2 and 3). Agitator paddle wheel 88 and metering wheel 89 are respectively driven by gears 100, 101. In turn, gears 100, 101 are driven by gear 102 which is powered by motor 82 through chain 103. Gears, 100, 101, 102 and chain 103 are enclosed by housing 104. Operation and speed of hydraulic motor 82 is controlled by manual bypass valve 105 situated on the sidewall of hopper 45 as seen in FIG. 3. Agitator paddle wheel 88 is employed so as to facilitate agitation, dispensing and movement of whatever topping material is placed in the respective hopper 45 or 46 for spreading on the wet concrete surface. Speed of rotation of metering wheel 89 substantially controls the speed and volume of material spread and also affects dissipation of the heat accumulated in the hydraulic fluid, as later described. Thus, by manually adjusting valve 105, motor 82 can be completely stopped by bypassing all of the fluid operated at full speed by stopping all fluid bypass or, by proper adjustment, operated at a less than full speed.

Figure 6:
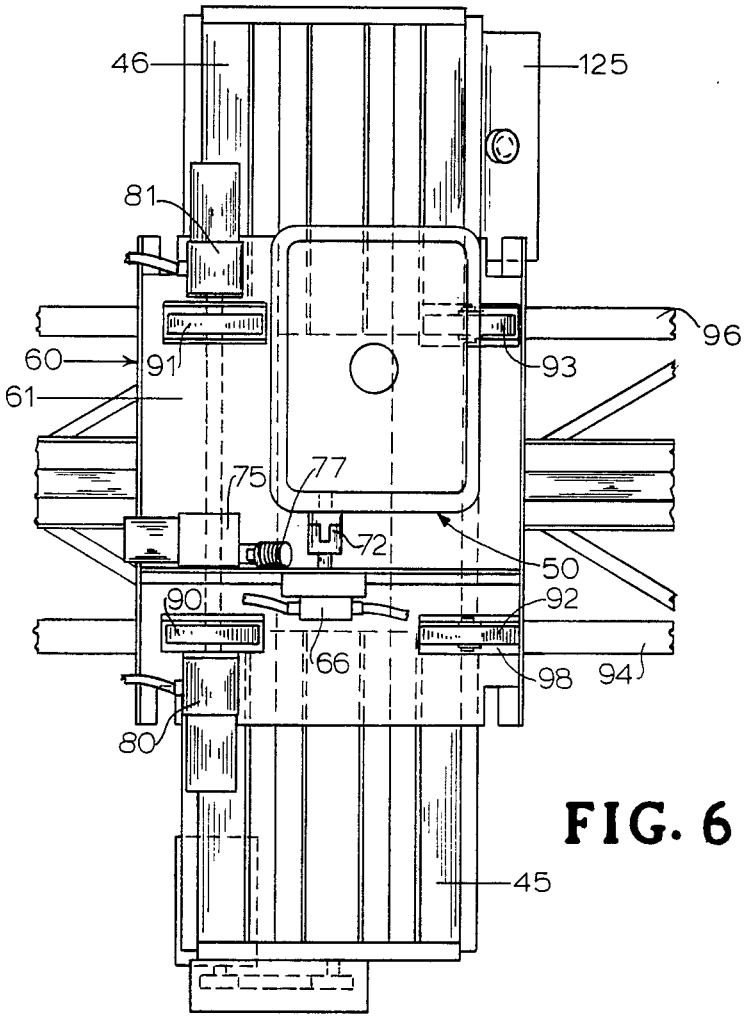
FIG. 6 is a top plan view of the invention appartus.

Both of the hoppers 45, 46 and spreader box 47 are preferably made of lightweight, heat conductive metal such as plate aluminum. Using hopper 46 and spreader box 47 as an example, hopper 46 and box 47 are bolted together as indicated at 48 to provide an overall complete hopper with the tops open as illustrated in FIGS. 1 and 6 for receiving the material to be spread.

Hydraulic control valve 75, through manipulation of lever 77, provides means for controlling the direction of flow to hydraulic motors 80, 81 and thus controls the direction in which the wheels 90, 91 move the hoppers 45, 46 and dispenser box 47 back and forth on the rails 94, 96. A hydraulic control of this type is well known and its use in the invention system of FIG. 8 will be understood by those skilled in the art.

In operation, engine 65 is started with control lever 77 in a neutral position allowing the hydraulic fluid to circulate from pump 66 through valve control 75 to reservoir 125 and then back to the pump 66 without flowing through hydraulic motors 80, 81 or 82. In this operating bypass mode there is, of course, very little heat generated in the hydraulic fluid as it simply circulates in the system. However, in normal operation, hoppers 45, 46 are filled with material to be spread and after each pass, one of the operators standing outside the concrete surface 30 and near the end of the pass manipulates control lever 77 so as to reverse the direction in which hydraulic motors 80, 81 are turning and thereby reverse the direction wheels 90, 91 move hoppers 45, 46 back and forth on bridge 22. Bypass valve 105 is also adjusted as required for the nature of the material being spread to control the speed of motor 82. The spreading operation inherently causes a substantial amount of heat to be generated in the hydraulic fluid. Thus, dissipation of this heat becomes a significant problem in successfully utilizing a small gasoline engine driven hydraulic system such as provided by the invention.

Figure 7:
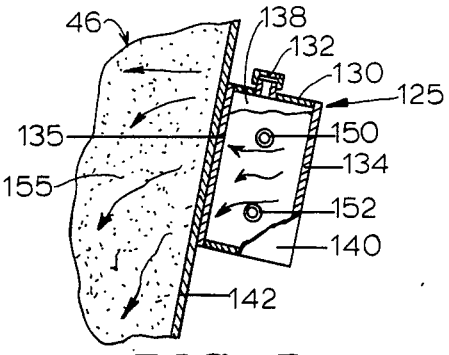
FIG. 7 is a fragmentary section view taken generally along line 7—7 of FIG. 2.

In the illustrated example, resevoir 125 is shown secured to a sidewall of hopper 46 formed of aluminum plate by way of example. Hoppers 45, 46 are fabricated of aluminum plate and reservoir 125 is also fabricated as a separate unit of aluminum plate and is made up of a top wall 130 (FIG. 7) having a fill cap 132, an outer wall 134, an inner wall 135, a bottom wall 136, an end wall 138 and an opposite end wall 140. The mentioned walls are welded to each other and back wall 135 is welded to the sidewall 142 of hopper 46. This arrangement thus provides a suitable structurally-sturdy and practical heat conducting reservoir 125 to which the incoming and outgoing hydraulic lines 150, 152 can be connected for bringing hot hydraulic fluid into and the cooled fluid out of the reservoir. As schematically illustrated in FIG. 7, the accumulated heat, indicated by the arrows, tends to dissipate itself both through the heat conducting back or inner wall 135 to hopper wall 142 as well as in the material 155 flowing in contact with wall 142 through hopper 46. Thus, the present invention recognizes that the accumulated heat can dissipate itself both in the metal structure of reservoir 125 and hopper wall 142 as well as in the material constantly flowing by wall 142 as the material is replenished. In the event of jamming, either of the hydraulically-driven and metering wheels 88, 89 or either of the hydraulically-driven drive wheels 90, 91, mention has been previously made of the ability of hydraulic motors 80–82 to provide a shock-absorbing clutch effect until lever 77 is appropriately positioned or the cause of the jamming relieved. In such situations, the hydraulic fluid may be heated excessively and thus heat dissipation becomes even more important to avoid damage to the various hydraulic system components.

What is claimed is:

1. A material spreader for spreading a uniform layer of material over a lengthwise extending, wet concrete surface bounded by opposed sides defining the width thereof, said spreader comprising:

(a) a bridge structure supported above and spanning the width of the concrete surface and having supporting means adapting said bridge structure to be moved along the length of said concrete surface;

(b) a support structure supported by wheels on said bridge structure and movable back and forth along an elevated path provided by said bridge structure and extending across the width of said concrete surface;

(c) hopper means comprising a pair of hoppers oppositely mounted on opposite sides of said bridge structure and a dispenser box having a top portion integral with and communicating with the bottoms of both said hoppers and a bottom portion providing a dispensing slot extending in a direction transverse to said elevated path and for the length of said dispenser box, said hopper means being supported from and below said support structure for storing material to be spread and dispensing such material through said slot as said hopper means and support structure move back and forth on said bridge structure, said hoppers and dispenser box being formed with heat conductive metal walls;

(d) a gasoline engine mounted on said support structure and having a drive shaft powered by said engine;

(e) a hydraulic pump mounted on said support structure and coupled to said drive shaft;

(f) a plurality of hydraulic motors fluidly connected for being driven by pressurized fluid produced by said pump;

(g) a reservoir for storing hydraulic fluid utilized by said pump and motors, said reservoir being formed of heat conductive metal walls as an integral unit and having a sidewall thereof mounted on an outside wall surface of one of said hoppers enabling heat stored by said fluid when in said reservoir to be dissipated through said reservoir sidewall and the wall of said hopper on which said reservoir sidewall is mounted and in material flowing thereby in contact with the interior wall surface of said hopper wall opposite the outside wall surface on which said reservoir is mounted;

(h) drive means on said support structure for driving said support structure on said bridge structure, said drive means including one or more of said hydraulic motors connected to drive one or more of said wheels;

(i) a paddle member extending for the length of and mounted in the lower area of said dispenser box for ejecting material therefrom through said slot, said paddle member having a drive connection to another of said motors for driving said paddle member to assist the flow of material through said slot during operation of said spreader; and (j) control valve and conduit means including an operator-control member and conduit interconnecting said pump, motors, reservoir and valve means positioned by said control member to allow selective stopping and reversing of the direction of said motors dependent on the position of said control member.

2. A material spreader as claimed in claim 1 including auxiliary valve means enabling the flow of hydraulic fluid to said motor driving said paddle member to completely bypass said paddle member drive motor to stop said paddle member rotation independent of the driving of said support structure back and forth on said bridge or in the alternative operate at full speed or less than full speed.

3. The method of cooling hot hydraulic fluid in a hydraulic fluid driven material spreader having a hopper with a heat conductive metal formed hopper wall comprising during operation of the spreader:

(a) flowing said hot fluid through a reservoir having a sidewall mounted on said heat conductive wall of said hopper and allowing the fluid heat to dissipate through said reservoir sidewall and said heat conductive wall of said hopper;

(b) flowing the material to be spread through said hopper in contact with said heat conductive wall on which said reservoir is mounted to allow said material to absorb said heat; and (c) assisting said flow and dissipation of said heat by use of a driven paddle member mounted adjacent the bottom of a material dispenser box in association with the bottom of said hopper.

* * * * *